United States Patent [19]

Boucherie

[11] Patent Number: 4,818,028

[45] Date of Patent: Apr. 4, 1989

[54] UNIVERSAL BRUSH CLAMP

[75] Inventor: Leonel Boucherie, Roeselare-Rumbeke, Belgium

[73] Assignee: Firma G.B. Boucherie, naamloze vennootschap, Izegem, Belgium

[21] Appl. No.: 78,645

[22] Filed: Jul. 28, 1987

[30] Foreign Application Priority Data

Aug. 5, 1986 [BE] Belgium ..... 2/61027

[51] Int. Cl.[4] ..... B25B 1/20

[52] U.S. Cl. ..... 300/10

[58] Field of Search ..... 300/2-11, 300/21

[56] References Cited

U.S. PATENT DOCUMENTS

| | | | |
|---|---|---|---|
| 2,851,308 | 9/1958 | Karle et al. | 300/10 |
| 3,279,858 | 10/1966 | Parker | 300/11 |
| 3,306,670 | 2/1967 | Zahoransky | 300/11 |
| 3,614,165 | 10/1971 | Ebser | 300/10 |

FOREIGN PATENT DOCUMENTS

| | | | |
|---|---|---|---|
| 1903771 | 8/1970 | Fed. Rep. of Germany | 300/10 |

*Primary Examiner*—Mark Rosenbaum

*Attorney, Agent, or Firm*—Foley & Lardner, Schwartz, Jeffery, Schwaab, Mack, Blumenthal & Evans

[57] ABSTRACT

Universal brush clamp characterized by the fact that it consists essentially of first and second elements between which a brush body is clamped, the clamping distance between these above-named elements being adjustable so as to be able to adapt the brush clamp for clamping brush bodies of any shapes and/or dimensions.

16 Claims, 2 Drawing Sheets

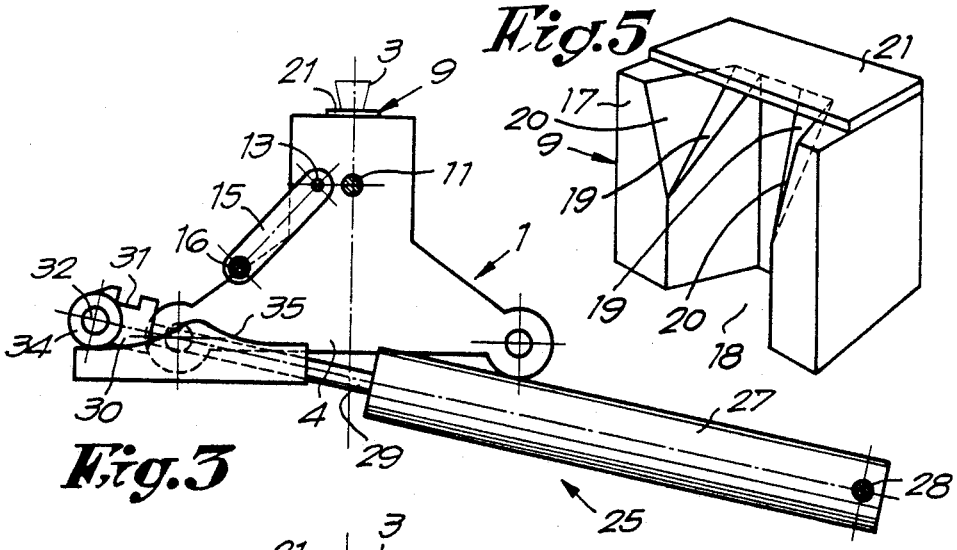
Fig.3
Fig.5
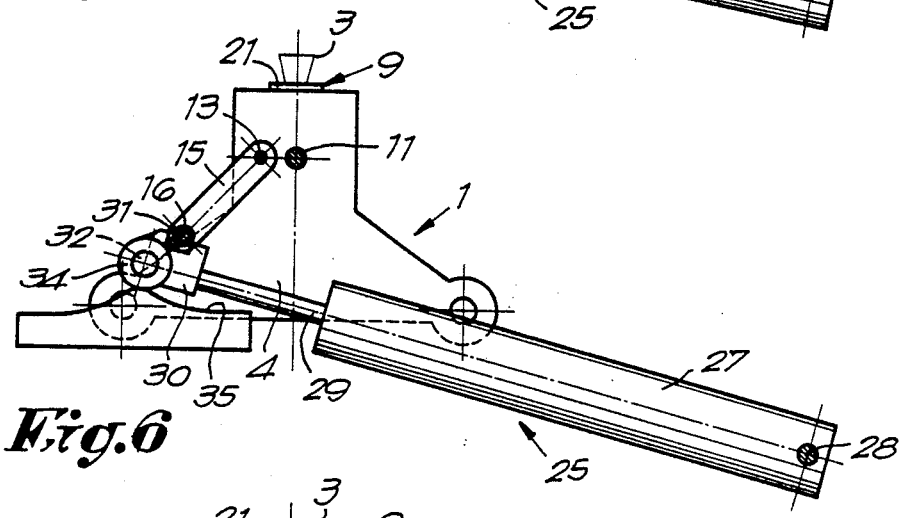
Fig.6
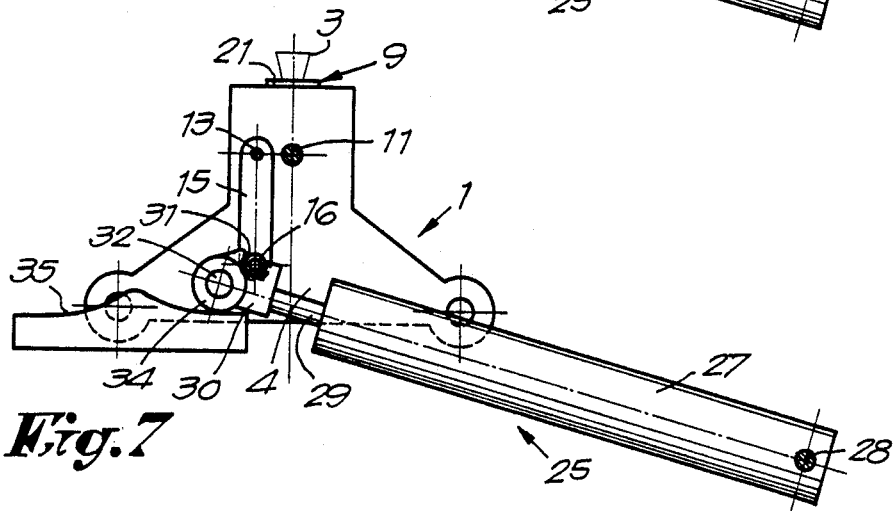
Fig.7

UNIVERSAL BRUSH CLAMP

BACKGROUND OF THE INVENTION

This invention concerns a universal brush clamp, i.e. a device by which it is possible with on universal clamp to fix different sorts of brush bodies in a brush-making machine or in the peripheral appliances of this brush-making machine.

It is known that so far each sort of brush body requires a separate brush clamping device that is applicable to it, for example by means of underlays applied to the back of the brush body and by suitable clamping devices. The consequence of this is that when a machine for making or processing brush bodies and/or brushes is switched from one type of brush to another type, each of the brush clamps or brush clamping devices named above has to be changed.

In view of the number of brush clamping devices in a brush-making machine or in the apparatus for processing the brush bodies and/or brushes, there being in general a relatively large number of such devices, and these devices being not only relatively complicated but also consisting of a large number of parts which have to be fitted together accurately, it is clear that changing these brush clamps is not only a time-consuming activity but also a very expensive affair.

One example which brings out this problem very clearly indeed is in the manufacture of toothbrushes in view of the number of brush clamping devices not only on these machines but in particular in the peripherals collaborating with these machines in the further processing of the brushes, such as trimming and the like, this number being very considerable.

SUMMARY OF THE INVENTION

Thus it is also the purpose of this invention to avoid the above-named and other disadvantages and to offer a brush clamp or brush clamping device that is universal, i.e. that is so designed that nearly all the different types of brush bodies can be fixed with it.

The universal brush clamp according to the invention consists for this purpose of first and second elements between which a brush body is clamped, the clamping distance between these elements being adjustable so that the brush clamp can be adapted for fixing brush bodies (3) of whatever shapes and/or dimensions. More particularly, the above-named elements are constituted by one fixed stop and one or more clamps which press the brush body against the fixed stop and cooperate with the latter to position the brush body accurately, the distance between the above-named stop and the clamp being adjustable.

BRIEF DESCRIPTION OF THE DRAWINGS

To gain a better insight into the characteristics of the invention, we give below an example, which is not limitative, of one possible version of a universal brush clamp of this type, with reference to the attached drawings in which:

FIGS. 3 and 4 respectively are sections along the lines III—III and IV—IV in FIG. 1;

FIG. 5 reproduces on a larger scale and in perspective the part indicated by F5 in FIG. 1;

FIGS. 6 and 7 are views similar to that of FIG. 3 but for positions assumed by the invention during the unlatching of the brush clamp;

DESCRIPTION OF THE PREFERRED EMBODIMENT

Figure 1:
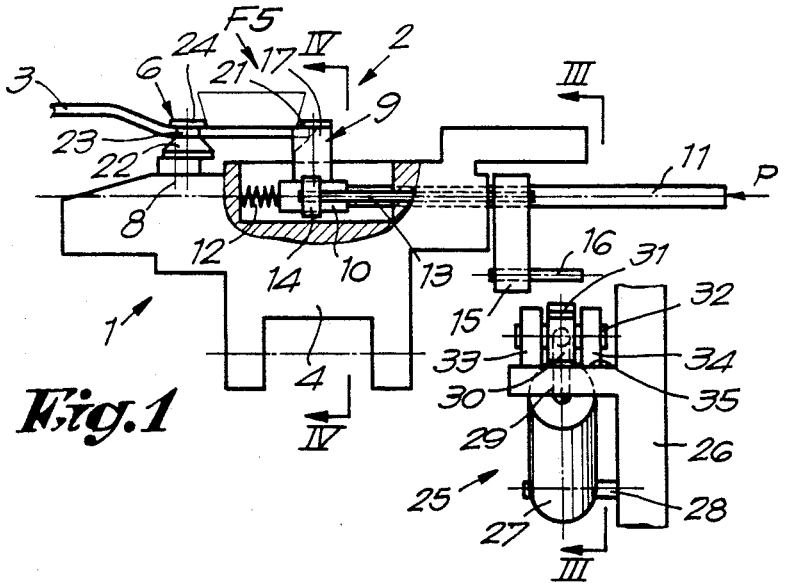
FIG. 1 gives a schematic and partially sectioned side view of a universal brush clamp according to the invention.

A support 1 for a brush clamp 2 for fixing a brush 3 is reproduced schematically in the FIGS. and in this specific case, the support 1 is constituted by one link 4 of a chain of which each link carries such a brush clamp 2.

Although in this example support 1 is shown as a link of a chain for handling the brushes 3, it is clear that this support can also form part of a so-called drum of a brush-making machine in which brush bodies 3 are clamped fast during the actual process of making a brush.

The universal brush clamp 2 according to the invention consists in this version principally of two clamping cams 5, 6 which can be suitably rotated round axes 7, 8, and a stop 9 fixed on a slide 10, which is guided in an appropriate manner, not shown on the drawing, in respect of support 1.

At one extremity of the slide 10 there is an extension 11, consisting of a rod or the like, whose purpose is to prolong the slide 10 outside the support 1, while between these support 1 and the other extremity of the slide 10, a spring 12 is provided.

In the support 1, apart from the slide 10, there is also a shaft 13 which can rotate freely and which, at the place of the slide 10, is provided with a cam 14 which, outside the support 1, is connected with a lever 15 of which the free extremity has a projection 16, in the form of a spindle for example.

The above-named fixed stop 9 consists principally of a lower part 17 provided with a U-shaped recess 18, the corners of which have triangular chamfered edges respectively 19–20, and above the part 17 a plate 21 is provided which projects over the chamfered edges 19 and 20.

The clamping cams 5 and 6 have a shape which is mainly as reproduced in FIG. 1, i.e. a conical part 22 that is connected, via a cylindrical part 23, with an extremity 24, the diameter of which is significantly larger that the smallest diameter of the above-named conical part 22.

Finally, the FIGS. also show an additional device 25 which, for example, is fixed to the fixed frame 26 of the machine, this device 25 consisting mainly of a pressure cylinder 27 which is connected with the frame 26 in such a way that it can be hinged by means of a shaft 28, and of which the piston rod 29 is fitted at its free extremity with a thickened part 30 in which there is a groove 31.

In the part 30, a shaft 32 is fixed, to which are applied one or two freely rotating runners, respectively 33 and 34.

These runners 33 and 34 cooperate with a cam 35 which is also connected to the machine frame 26.

Figure 2:
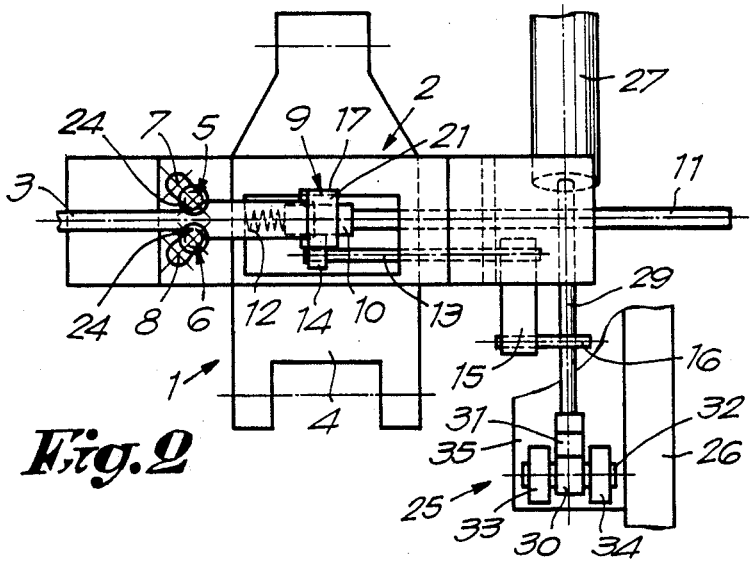
FIG. 2 gives a view from above of FIG. 2.
Figure 4:
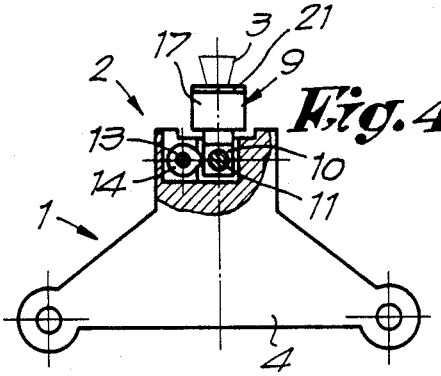

Clamping a brush body 3 in a universal clamp according to the invention is carried out simply by adjusting the fixed stop 9 to a certain position and subsequently placing the brush body in the clamp, more particularly on the chamfered edges 19–20 of the fixed stop 9 and the conical part 22 of the cams 5–6. By subsequently pressing the brush body against the triangular chamfered edges 19 and 20 of the fixed stop 9 by means of the clamping cams 5 and 6 which are brought to bear on the brush body for this purpose, as shown in FIGS. 1 and 2, the following occurs:

The brush body, by the cooperation of, on the one hand, the triangular chamfered edges 19–20 of the fixed stop 9 and, on the other hand, of the conical part 22 of the clamping cams 5 and 6, during the action of these clamping cams, simultaneously pressing it against the stop 9, is displaced upwards until the brush body 3 lies cleanly against, on the one hand, the plate 21 of the fixed stop 9 and, on the other hand, the part 24 of each clamping cam 5 and 6.

In this way, because of the shape of the stop 9 and of the clamping cams 5 and 6, the positioning and fixing of a brush body becomes a simple matter.

With the object of making such a brush clamp independent of the shape and/or length of the brush body 3, apart from the above-mentioned measures, we have also aimed at an adjustment of the fixed stop 9, so as to make universal adaptation both in length and height possible.

This second adjustment is obtained by the displacement of the slide 10.

The latter is always held fast against the action of the spring 12 by, for example, the cam 14 which clamps against the slide 10. At that moment, the device is in the position as shown in FIGS. 1 to 4; in other words the slide 10 together with the extension 11, is immovable. For this purpose the cam 14 acts on the slide 10 and the spring 12 has no effect.

Figure 8:
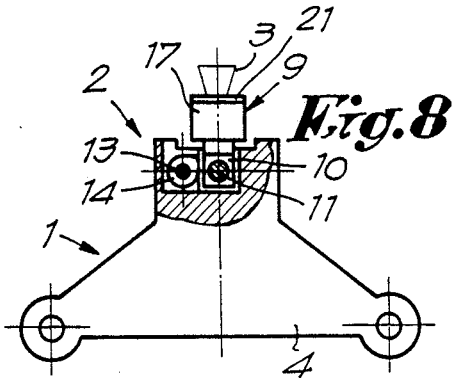
FIG. 8 gives a view that is similar to that of FIG. 4 but for a second position of the brush clamp.

When at a given moment in the manufacture or treatment of a determined type of brush body, a change is made to the production or treatment of brushes with another form of brush body, then the pressure cylinder 27 is involved. For this purpose the slot 31 is displaced in the bulge 30 towards the lever 15—see FIG. 6—and all this happens in such a way that, through the presence of the cam 35, the above-named slot 31 comes into contact with the spindle 16 on the lever 15, and thus when this movement is continued further, as shown in FIG. 7, this lever is displaced in such a way that the cam 14 is turned as shown in FIG. 8. At that moment, the slide is freed, and the spring 12 can act on it to push it back.

It suffices at this moment, by exercising an appropriate pressure, in the direction of the arrow P, on the rod 11, to bring the slide 10 and thus the stop 9 into a suitable position in respect of the support 1 so as subsequently again to activate the pressure cylinder 27 in order to move from the position as shown in FIG. 7 into the position as shown in FIG. 3 and thereby to fix the slide 10 in the determined position in respect of support 1 by the clamping of cam 14.

It is clear that the above-mentioned process must be carried out for each brush clamp present in the machine, i.e. when this brush clamp is placed against the device 25, the adjustment will vary until all the clamps are adjusted and work can subsequently be continued with the new brush type.

The pressure exercised in the direction of the arrow P can be exercised either manually or automatically, and this pressure can be obtained either by letting the various prolongations 11 of each slide 10 cooperate with a suitably profiled guide, or by exercising a pressure P at the appropriate place on these prologations 11 which can be controlled in any manner desired.

Obviously this invention is in on way limited to the variant described as an example and shown in the accompanying drawings and a universal brush clamp of this type or the elements cooperating with it according to the invention can be realized in all sorts of forms and dimensions.

It is in any case clear that the universal brush clamp according to the invention applied to all possible clamps for fixing brush bodies in a brush-making machine or a machine for the processing of brush bodies and/or brushes, independently of whether the elements named above, respectively the fixed stop and the clamp or clamps, are placed against each other following the length, or the breadth, or according to a diagonal or similar element of the brush body.

What is claimed is:

1. A universal brush clamp, comprising:

a first and second clamping cam means having angled brush receiving surfaces; and an adjustable stop having a chamfered brush engaging surface;

said angled brush receiving surfaces comprising a conical lower portion, a cylindrical central portion coterminous therewith and an upper brush retaining portion;

said adjustable stop having an upper brush retaining plate fixed above said chamfered brush engaging surface;

said chamfered brush engaging surface and said conical lower portions of said angled brush receiving surfaces being angled to displace a brush body along said surfaces to a clamped position.

2. The clamp according to claim 1, wherein the stop can have its distance adjusted and set in relation to the clamping cam means.

3. The clamp according to claim 1, wherein the stop is adjusted on a slide relative to the clamping cam and can be brought to and fixed in any desired position.

4. The clamp according to claim 3, wherein the slide is movably mounted on a support and a spring is provided which urges the slide in one direction, the slide having an extension for adjusting the position of the slide.

5. The clamp according to claim 3, wherein the slide is held fast in respect to the support by a clamping action.

6. The clamp according to claim 5, wherein another cam acts on the slide.

7. The clamp according to claim 6, wherein said another cam is fixed on a shaft which extends outside the support and is provided with means for turning said cam.

8. The clamp according to claim 7, wherein the turning means are formed by a lever with which a control device can cooperate.

9. The clamp according to claim 8, wherein the control device is formed by a projection on the lever, and a slot is applied to the free extremity of a piston rod of a pressure cylinder, this free extremity being displaced along a further cam so as to bring the slot in contact with or respectively to free it from the projection.

10. The clamp according to claim 9, wherein the slot is applied to a bulge on the extremity of the piston rod, and through the bulge there is a shaft provided with runners which follow the further cam.

11. The clamp according to claim 1, wherein adjustement of the clamp is made by displacing the clamping cam means relative to the stop.

12. The clamp according to claim 11, wherein the adjustment of the clamp is made by the joint displacement of said clamping cam means and said stop on a given machine.

13. The clamp according to claim 11, wherein the adjustment is made manually.

14. The clamp according to claim 13, wherein the adjustment is made via a pressure cylinder.

15. The clamp according to claim 14, wherein the adjustment is made via a motor.

16. The clamp according to claim 1, wherein as a function of the dimensions of the brush bodies, the relative position of the clamping cam means and the stop is adapted automatically by a setting device.

* * * * *